United States Patent [19]

Rummage et al.

[11] Patent Number: 4,957,270

[45] Date of Patent: Sep. 18, 1990

[54] CONCRETE COLUMN FORMING TUBE

[75] Inventors: Tony F. Rummage; John T. Wise; Charles D. Foehrenbach; McCleery B. Cunningham, all of Hartsville, S.C.

[73] Assignee: Sonoco Products Company, Hartsville, S.C.

[21] Appl. No.: 294,101

[22] Filed: Jan. 5, 1989

[51] Int. Cl.[5] ..... E04G 13/02

[52] U.S. Cl. ..... 249/48; 249/51; 249/61; 249/112; 249/115; 249/134; 249/DIG. 2

[58] Field of Search ..... 249/48, 51, 61, 112, 249/114.1, 115, 134, DIG. 2

[56] References Cited

U.S. PATENT DOCUMENTS

| | | | |
|---|---|---|---|
| 2,677,165 | 5/1954 | Copenhaver et al. | 249/48 |
| 2,836,874 | 6/1958 | Clarkson | 249/48 |
| 2,888,043 | 5/1959 | Reid | 138/144 |
| 2,914,833 | 12/1959 | Hart, Jr. et al. | 249/48 |
| 2,922,343 | 1/1960 | Dunlap, Jr. et al. | 493/272 |
| 2,991,533 | 7/1961 | Reid et al. | 249/48 |
| 3,301,926 | 1/1967 | Reiland | 249/48 |
| 3,644,611 | 2/1972 | Wiles | 249/48 |
| 4,083,526 | 4/1978 | Hatfield | 249/48 |
| 4,595,168 | 6/1986 | Goodwin | 249/48 |
| 4,767,095 | 8/1988 | Fitzgerald et al. | 249/48 |

FOREIGN PATENT DOCUMENTS

| | | | |
|---|---|---|---|
| 828415 | 2/1960 | United Kingdom | 249/48 |

*Primary Examiner*—James C. Housel

*Attorney, Agent, or Firm*—Bell, Seltzer, Park & Gibson

[57] ABSTRACT

A concrete column forming tube is provided for receiving poured concrete therein to produce a concrete column and which is characterized by producing surface characteristics on the concrete column including a matte finish without seam lines of the forming tube. A flexible cylindrical liner is positioned in a generally friction-fit relationship within an elongate rigid cylindrical tube constructed of partially-overlapped spirally-wound plies of paper adhered together and defining an inside wall surface having spiral seam lines thereon. The flexible liner is constructed of a paperboard layer secured at butted edges and having an inside wall surface of desired paper fiber matte texture and a thickness sufficient to bridge and cover the spiral seam lines on the inside wall surface of the rigid tube to prevent the formation of seam lines on the outside surface of the produced concrete column. A thin plastic coating layer is laminated to the inside wall surface of the paperboard layer and has a thickness sufficiently thinner than the paperboard layer so that the plastic coating layer assumes the desired paper fiber matte texture of the inside wall surface of the paperboard layer to produce a concrete column with a matte finish on the outside surface.

6 Claims, 1 Drawing Sheet

CONCRETE COLUMN FORMING TUBE

FIELD OF THE INVENTION

This invention relates to a concrete column forming tube for receiving poured concrete therein to produce a concrete column and which is characterized by producing improved surface characteristics on the concrete column including a paper fiber matte finish without seam lines of the forming tube.

BACKGROUND OF THE INVENTION

For many years, concrete column forming tubes were utilized which were constructed of partially-overlapped spirally-wound plies of paper adhered together and defining an inside wall surface of predetermined diameter which was coated with plastic material by coating one side of the paper plies prior to spiral winding for concrete release properties. These forming tubes received poured concrete therein which dried and set-up to produce a concrete column. The forming tube was then stripped away leaving the produced concrete column. Due to the spirally-wound construction of such forming tubes, spiral seam lines were present on the inside wall surface of the forming tube which resulted in spiral lines molded on the outside surface of the produced concrete columns. From an aesthetic standpoint, these spiral lines were often undesirable on the produced concrete columns and sand blasting or other finishing techniques were necessary to produce a smooth outside surface on the concrete columns. Additionally, it was found that moisture from the poured concrete was absorbed by these concrete column forming tubes and that as the concrete of the column hardens, it reabsorbs such moisture leaving an undesirable stain at spiral seam on the surface of the columns.

In an effort to overcome these problems, a plastic lined concrete column forming tube was proposed by U.S. Pat. No. 4,595,168. This patent proposed the use of a separate all plastic tubular liner positioned inside a rigid cylindrical tube of partially-overlapped spirally-wound plies of paper adhered together and which purportedly would eliminate the spiral seam lines on the surface of the concrete column and provide a moisture barrier on the inside wall of the forming tube. While this plastic lined concrete column forming tube did overcome some of the problems present with the earlier concrete column forming tubes, it did not produce a completely satisfactory concrete column. For example, the all plastic liner when used in hot climates tends to become soft and produce undesirable surface characteristics on the surface of the concrete column. Additionally, the all plastic liner of this concrete column forming tube usually produced a glossy, marble-like or mottled surface on the concrete columns which was undesirable from the standpoint of maximizing surface imperfections created by poor aggregate mix in the poured concrete, etc.

OBJECT AND SUMMARY OF THE INVENTION

Accordingly, it is the object of this invention to provide an improved concrete column forming tube which overcomes the problems set forth above with prior concrete column forming tubes.

It has been found by this invention that this object may be accomplished by providing a concrete column forming tube which is characterized by producing improved surface characteristics on the concrete column including a paper fiber matte finish without spiral seam lines of the forming tube. The forming tube includes an improved liner for use in an elongate rigid cylindrical tube constructed of partially-overlapped, spirally-wound plies of paper adhered together and defining an inside wall surface of predetermined diameter and having spiral seam lines thereon.

The improved liner is of flexible cylindrical construction and of predetermined diameter positioned inside the rigid tube in a generally friction-fit relationship. The cylindrical liner includes a paperboard layer secured at butted edges and having an inside wall surface of desired paper fiber matte texture and a thickness sufficient to bridge and cover the spiral seam lines on the inside wall surface of the rigid tube to prevent the formation of seam lines on the outside surface of the produced concrete column. A thin plastic coating layer is laminated to the inside wall surface of the paperboard layer to provide a moisture-impervious inside wall surface for the forming tube which can be easily stripped from the produced concrete column and has a thickness sufficiently thinner than the paperboard layer so that the plastic coating layer assumes the desired paper fiber matte texture of the inside wall surface of the paperboard layer to produce a concrete column with a paper fiber matte finish on the outside surface.

This improved liner for a concrete column forming tube of the present invention is less expensive to produce than the all plastic liner of the above discussed prior art patent and provides a much more desirable textured finish on the concrete column which is made possible by utilizing the paper felt marks and paper fiber orientation which may be varied and constructed as desired during the papermaking operation for the paperboard layer utilized in the liner. By the use of a very thin plastic coating layer laminated to the inside wall surface of the paperboard layer, the thin plastic coating layer will assume the desired texture of the surface of the paperboard layer to provide the paper fiber matte texture on the inside wall surface of the liner.

Notwithstanding the above improvements of the liner of the present invention, it has been found that such improved liner sometimes presents problems with dimensional stability. When the concrete column forming tube of this invention is used in certain environments, for example where rain or high humidity is present or where excessive heat or sun is present, the moisture content of the paperboard layer of the cylindrical liner may change causing a slight change in the dimensions and diameter of the cylindrical liner resulting in an undesirable friction-fit relationship of the liner in the forming tube, i.e. the paperboard layer of the liner may expand causing buckles or wrinkles in the liner because it is too large for a proper friction-fit within the forming tube or it may contract making the dimensions and diameter too small for a proper friction-fit within the forming tube.

Accordingly, to overcome these problems, the present invention has proposed that, as alternative constructions, the cylindrical liner may further include a second thin plastic coating layer laminated to an outside wall surface of the paperboard layer for effectively encapsulating the paperboard layer within the plastic layers to prevent changes in moisture content in the liner or the paperboard layer of the cylindrical liner may include many accordion-type folds in the axial direction of the liner and the forming tube for respective expansion or contraction of the diameter of the paperboard layer to compensate for changes in moisture content in the paperboard layer of the liner. Both of these alternative constructions provide dimensional stability to the liner and ensure a desired, generally friction-fit relationship of the liner in the forming tube.

BRIEF DESCRIPTION OF THE DRAWINGS

While some of the advantages of the present invention have been set forth above, other advantages will become apparent from the description of the preferred embodiment of this invention when taken in conjunction with the accompanying drawings, in which.

DETAILED DESCRIPTION OF PREFERRED EMBODIMENT OF THE INVENTION

Figure 1:
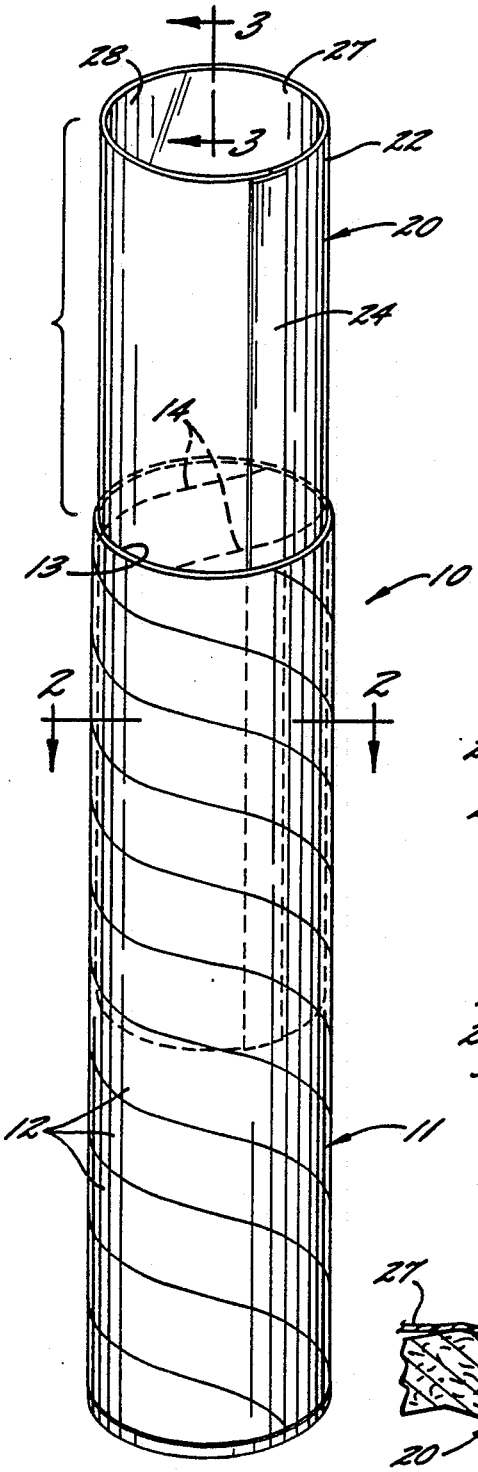
FIG. 1 is a partially-exploded perspective view of a concrete column forming tube constructed in accordance with this invention.
Figure 2:
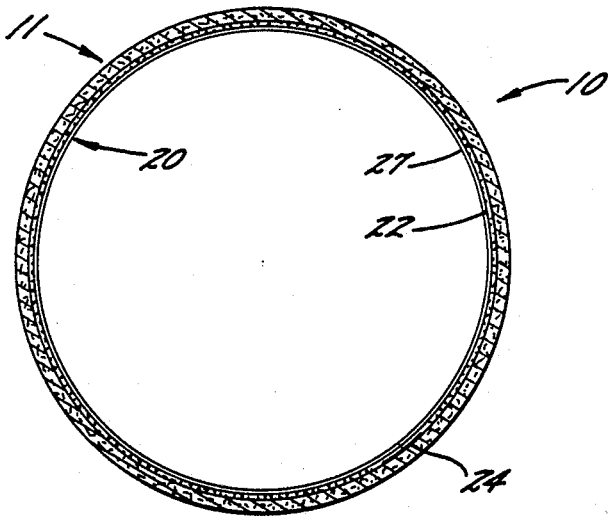
FIG. 2 is an enlarged sectional view through the concrete column forming tube of FIG. 1 and taken generally along the line 2—2 of FIG. 1.
Figure 3:
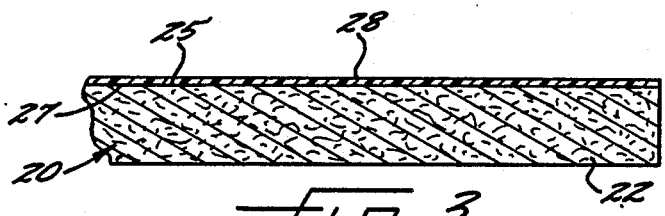
FIG. 3 is a greatly enlarged sectional view of the improved liner of the concrete column forming tube of the present invention and taken generally along the line 3—3 of FIG. 1.

Referring now to the drawings, a partially exploded view of the concrete column forming tube, generally indicated at 10, is shown in FIG. 1. This concrete column forming tube 10 comprises firstly, an elongate rigid cylindrical tube 11 constructed from a plurality of partially-overlapped spirally-wound plies of paper 12 adhered together and defining an inside wall surface 13 of predetermined diameter and having spiral seam lines 14 thereon. The spiral seam lines 14 on the inside surface 13 of the tube 11 extend throughout the length thereof just as the spiral seam lines on the outside surface of the tube 11. Spiral winding of a plurality of plies 12 to form such a tube is well understood by those with ordinary skill in the art and further explanation herein is not deemed necessary.

The concrete column forming tube 10 further includes a flexible cylindrical liner 20 of predetermined diameter positioned inside the rigid tube 11 in a generally friction-fit relationship. The length of the flexible liner 20 is generally the same as the rigid tube 11 so that the liner will completely cover the inside wall surface 13 of the rigid tube 11 when positioned therein (FIG. 1 shows tube 11 and liner 20 in partially exploded relationship for illustration purposes). By being flexible, the liner 20 may be flexed for positioning inside the rigid tube 11.

The flexible cylindrical liner 20 comprises a generally rectangular paperboard layer 22 closed on itself with its longitudinal edges abuttingly arranged and defining a seam along which a by sealing tape 24 is applied to the outside surface thereof over the butted edges, as shown in FIG. 1 for securing the butted edges together and maintaining the paperboard layer 22 in the cylindrical configuration. The paperboard layer 22 has an inside wall surface 25 of desired paper fiber matte texture which can be produced on the paper machine utilizing paper felt marks and paper fiber orientation in varying forms, as well understood by those with ordinary skill in the art. The paperboard layer 22 also includes a sufficient thickness, preferably about .035 to .060 inch, to bridge and cover the spiral seam lines 14 on the inside wall surface 13 of the rigid tube 11 to prevent the formation of seam lines on the outside surface of the produced concrete column.

The flexible cylindrical liner 20 further includes a thin plastic coating layer 27, preferably low density polyethylene or similar material, laminated to the inside wall surface 25 of the paperboard layer 22 to provide a moisture impervious inside surface 28 for the forming tube 10 which can be easily stripped from the produced concrete column. The plastic coating layer 27 has a thickness sufficiently thinner than the paperboard layer 22, preferably about .002 inch, so that the plastic coating layer 27 assumes the desired paper fiber matte texture of the inside wall surface 25 of the paperboard layer 22 to provide an inside wall surface 28 of the same paper fiber matte texture to produce a concrete column with a matte finish on the outside surface thereof.

Accordingly, if may be seen that the concrete column forming tube 10 of the present invention has overcome problems produced by prior concrete column forming tubes and has provided an improved cylindrical liner 20 which is not only more economical to manufacture, but which also provides improved surface characteristics on the produced concrete column including a paper fiber matte finish without seam lines of the forming tube.

Figure 4:
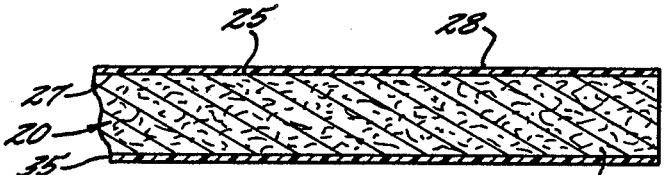
FIG. 4 is a view, like FIG. 3, of a greatly enlarged section of an alternative construction of the improved liner of the concrete column forming tube of the present invention.
Figure 5:
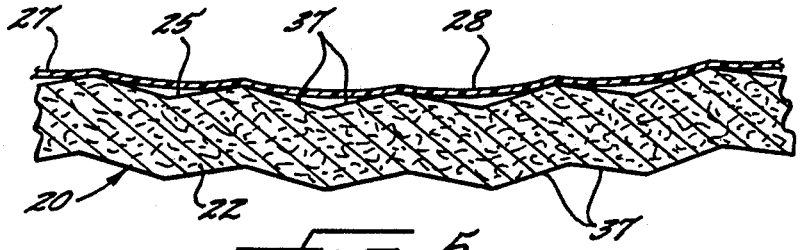
FIG. 5 is a view, like FIGS. 3 and 4, of a further alternative construction of the improved liner of the concrete column forming tube of the present invention.

Referring now to FIGS. 4 and 5 of the drawings, there are shown therein two alternative constructions of the flexible cylindrical liner 20 of the present invention which are intended to overcome the above discussed problems of dimensional stability of the liner 20 when changes in moisture in the liner 20 are likely to occur due to conditions present when forming concrete columns. In these alternative constructions of the liner 20, like reference numerals have been used for like components of the liner 20, as described above.

In FIG. 4, there is shown a cylindrical liner 20 which further includes a second thin plastic coating layer 35 laminated to the outside wall surface of the paperboard layer 22 for effectively encapsulating the paperboard layer 22 within the plastic layers 27, 35 to prevent changes in moisture content in the paperboard layer 22 and provide dimensional stability to the liner 20 and ensure a desired, generally friction-fit relationship of the liner 20 in the forming tube 11.

Referring now to FIG. 5, there is shown a liner 20 in which the paperboard layer 22 includes many accordion-type folds 37 in the axial direction of the liner 20 and the forming tube 10 for respective expansion or contraction of the diameter of the paperboard layer 22 to compensate for changes in moisture content in the paperboard layer 22 of the liner 20 and provide dimensional stability to the liner 20 and ensure a desired, generally friction-fit relationship of the liner 20 in the forming tube 11. These accordion-type folds are greatly enlarged and exaggerated in FIG. 5. Also, when the liner 20 is flexed and friction-fitted into the forming tube 11, the accordion-type folds will provide a generally smooth surface under the plastic layer 27.

In the drawings and specification there has been set forth a preferred embodiment of this invention, and although specific terms are employed, they are used in a generic and descriptive sense only and not for purposes of limitation, the scope of the invention is defined in the following claims.

What is claimed is:

1. A concrete column forming tube for receiving poured concrete therein to produce a concrete column and characterized by producing surface characteristics on the concrete column including a paper fiber matte finish without seam lines of the forming tube; said forming tube comprising:

an elongate rigid cylindrical tube capable of receiving concrete therein to form a column and comprising partially-overlapped spirally-wound plies of paper adhered together and defining an inside wall surface having spiral seam lines thereon; and a separately formed flexible cylindrical liner positioned inside said rigid tube in a generally friction-fit relationship and comprising a generally rectangular layer of paperboard material closed on itself with its longitudinal edges abuttingly arranged and defining a seam, and a sealing tape positioned on the outside of said paperboard layer along said seam for maintaining the paperboard layer in tubular form, said paperboard layer having an inside wall surface of desired paper fiber matt texture and a thickness sufficient to bridge and cover said spiral seam lines on said inside wall surface of said rigid tube to prevent the formation of seam lines on the outside surface of the produced concrete column, and a thin plastic coating layer laminated to said inside wall surface of said paperboard layer to provide a moisture-impervious inside wall surface for said forming tube and having a thickness sufficiently thinner than said paperboard layer so that said plastic coating layer assumes the desired paper fiber matt texture of said inside wall surface of said paperboard layer to produce a concrete column with a paper fiber matt finish on the outside surface.

2. A concrete column forming tube, as set forth in claim 1, in which said cylindrical liner further includes a second thin plastic coating layer laminated to an outside wall surface of said paperboard layer for effectively encapsulating said paperboard layer within said plastic layers to prevent changes in moisture content in said paperboard layer and provide dimensional stability to said liner and ensure a desired, generally friction-fit relationship of said liner in said forming tube.

3. A concrete column forming tube, as set forth in claim 1, in which said paperboard layer of said cylindrical liner includes accordion folds in the axial direction of said liner and said forming tube for respective expansion or contraction of the diameter of said paperboard layer to compensate for changes in moisture content in said paperboard layer of said liner and provide dimensional stability to said liner and ensure a desired, generally friction-fit relationship of said liner in said forming tube.

4. A concrete column forming tube, as set forth in claim 1, 2 or 3 in which the thickness of said paperboard layer of said liner is approximately 0.035 to 0.060 inch and in which the thickness of said plastic coating layer on said inside surface of said liner comprises approximately 0.002 inch.

5. A concrete column forming tube, as set forth in claim 1, 2 or 3 in which said plastic coating layer of said liner comprises low density polyethylene.

6. A concrete column forming tube, as set forth in claim 1, 2 or 3, in which the thickness of said paperboard layer of said liner is approximately 0.035 to 0.060 inch, and the thickness of said plastic coating layer on said inside surface of said liner is approximately 0.002 inch, and said plastic coating layer of said liner comprises low density polyethylene

* * * * *

UNITED STATES PATENT AND TRADEMARK OFFICE

CERTIFICATE OF CORRECTION

PATENT NO. : 4,957,270

DATED : September 18, 1990

INVENTOR(S) : Rummage et al.

It is certified that error appears in the above-identified patent and that said Letters Patent is hereby corrected as shown below:

Column 3, line 63, delete "by".

Column 6, line 26, delete "comprises" and insert -- is --.

Signed and Sealed this

Thirty-first Day of December, 1991

*Attest:*

HARRY F. MANBECK, JR.

*Attesting Officer*

*Commissioner of Patents and Trademarks*